United States Patent [19]

Adiletta

[11] 3,980,238

[45] Sept. 14, 1976

[54] FILTER NOZZLE FOR AIR GUN

[75] Inventor: Joseph G. Adiletta, Thompson, Conn.

[73] Assignee: Pall Corporation, Glen Cove, N.Y.

[22] Filed: Nov. 24, 1975

[21] Appl. No.: 634,570

[52] U.S. Cl. ..... 239/590.3; 239/DIG. 22

[51] Int. Cl.[2] ..... B05B 1/14

[58] Field of Search ..... 239/590.3, DIG. 21, 239/DIG. 22, 590, DIG. 23, 586

[56] References Cited

UNITED STATES PATENTS

| | | | |
|---|---|---|---|
| 2,242,680 | 5/1941 | Schacht | 239/DIG. 23 |
| 2,664,312 | 12/1953 | Czarnecki et al. | 239/590.3 |
| 3,129,892 | 4/1964 | Tillman | 239/586 X |
| 3,362,640 | 1/1968 | Fainman | 239/590.3 X |
| 3,445,069 | 5/1969 | Druge | 239/586 X |
| 3,790,085 | 2/1974 | Ayer | 239/DIG. 22 |

FOREIGN PATENTS OR APPLICATIONS

| | | | |
|---|---|---|---|
| 20,740 | 12/1918 | France | 239/590.3 |

*Primary Examiner*—Robert S. Ward, Jr.

[57] ABSTRACT

A filter nozzle is provided for air guns, comprising, in combination, a filter housing, having an air channel therethrough and adapted to be mounted to an air outlet of an air gun, an air nozzle removably attached to the filter housing, in fluid flow connection with the air channel, for restricting and directing the air from the air gun as an air stream; and a filter removably attached to the filter housing across the air channel upstream of the nozzle so that air passing through the channel must pass through the filter before passing through the nozzle.

11 Claims, 3 Drawing Figures

FILTER NOZZLE FOR AIR GUN

Air guns are in wide use for drying and cleaning machinery and equipment. In industrial establishments requiring many such guns, high pressure air lines are provided, to which the guns may be attached, and the guns are then used to direct a jet stream of air against the machine part or component to be dried or cleaned.

A typical air gun of this type is described in U.S. Pat. No. 3,445,069 to Druge. Such air guns normally include a filter in the line of the flow from the pressure air line to the gun, designated as 13 in FIGS. 1 and 2 of the patent. However, the air streams from air guns tend to scratch critical surfaces of parts being cleaned or dried, despite the presence of the filter in the flow line in the manner shown by Druge.

In accordance with the invention, it has now been determined that such scratching and damage of parts surfaces results from submicroscopic particles which originate in the air gun mechanism itself, and in the air lines, due to wear or abrasion of metal parts. A microporous filter therefore is provided, disposed across the air outlet of an air gun, to trap such microscopic particles, and it has been found that this device eliminates the scratching and damage problem.

Accordingly, the invention provides a filter nozzle for air guns, comprising, in combination, a filter housing having an air channel therethrough, and adapted to be mounted to an air outlet of an air gun; an air nozzle removably attached to the filter housing and having an air channel therethrough in fluid flow connection with the air channel thereof for restricting and directing the air from the air gun as an air stream, and a filter removably attached to the filter housing across the air channel upstream of the nozzle, so that pressurized air passing through the channel must pass through the filter before passing through the nozzle.

A preferred embodiment of the filter nozzle in accordance with the invention is shown in the drawings, in which.

Figure 1:
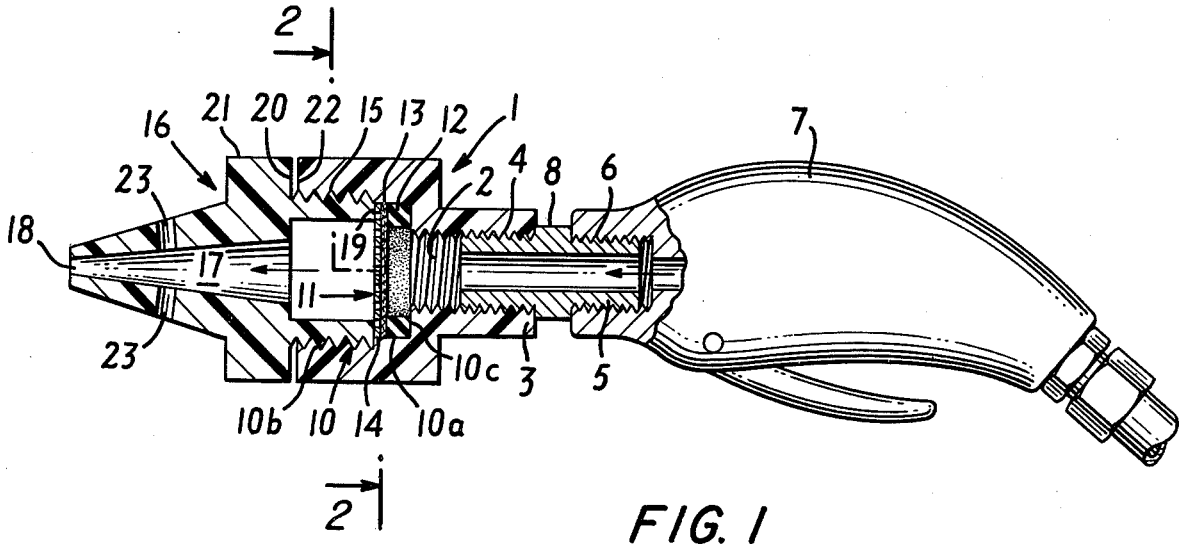
FIG. 1 represents a longitudinal sectional view through the filter nozzle, shown attached to the air outlet of an air gun by way of an adaptor.

The filter nozzle shown in the Figures is made of plastic, such as a polyamide resin, or an acetal copolymer, of which a commercially available form is sold under the trademark Celcon, but metal can also be used, such as stainless steel, titanium alloy, brass, or bronze.

The filter nozzle of the invention can be fitted to the air outlet of any type of air gun, and consequently the structure of the air gun is not shown in detail in the drawings, since it is entirely conventional, and forms no part of the instant invention. All that is shown in the drawing is the air outlet opening of a typical air gun, to which the filter nozzle of the invention is fitted.

Figure 2:
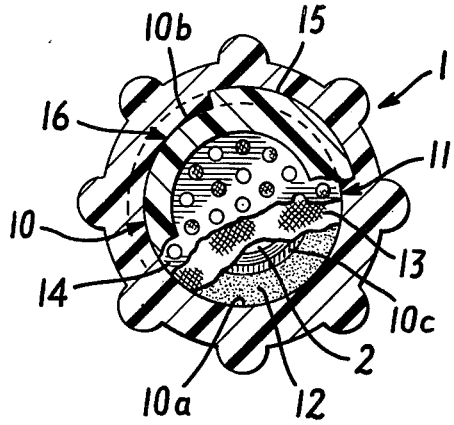
FIG. 2 represents a cross-sectional view taken along the lines 2—2 of FIG. 1.
Figure 3:
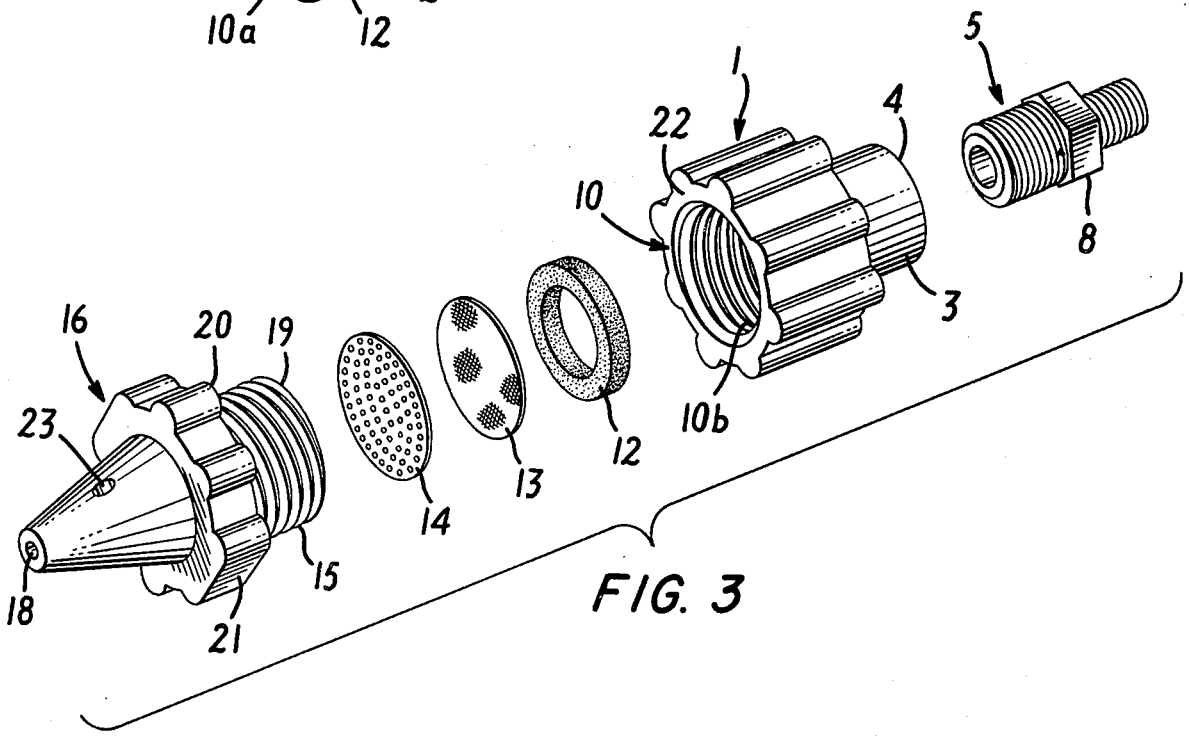
FIG. 3 is an exploded detailed view of the nozzle and filter assembly shown in FIGS. 1 and 2.

The filter nozzle seen in FIGS. 1 to 3 is composed of a filter housing 1, having a tubular central air channel 2 therethrough. At the air gun-end 3, the inlet end, according to the direction of air flow through the filter nozzle, shown by the arrows, the air channel is internally threaded at 4, and receives a mating threaded cylindrical adaptor 5, which is externally threaded into the threaded inlet opening 6 of the air gun 7, thus securely attaching the filter nozzle to the air gun air outlet 6. The adaptor 5 has a central hexagonal section 8 to receive a wrench for tightening into the inlet opening 6 and the air gun 7.

Downstream of the threaded portion 4, the air channel 2 of the filter housing opens out into a wide cylindrical bore 10, which at its inner end 10a receives a filter assembly 11 and a flat ring gasket 12, providing a leak-tight connection at the periphery of the filter with the housing 1 at the end of bore 10, and preventing leakage past the periphery of the filter assembly 11, so that all air flowing through the air channel 2 must pass through the filter assembly 11.

The filter assembly, as best seen in the exploded view of FIG. 3, comprises a filter disc 13 of hydrophobic microporous filter sheet, in this case a glass fiber fabric impregnated with silicone and phenolformaldehyde resin and having a maximum pore size of approximately 1.5 $\mu$, an average pore size of 0.6 $\mu$, and an open volume of 90 percent. Under the high rate of flow and high air pressure of the air stream from the air gun, this filter requires back-up support, provided in the form of a perforated stainless steel disc 14 (or wire screen), also preferably of stainless steel.

The bore at its inner end **10*a* has smooth sides, for better sealing of the gasket 12 to the filter housing 1, but beyond the recess 10 in portion 10*b* the pore is threaded, and receives the externally threaded cylindrical stub end 15 of the nozzle 16. The nozzle 16 has a tapered air channel 17 therethrough, terminating in a narrow tip opening or orifice 18, whose size and shape determines the air stream emerging from the nozzle 16. As an example, in the embodiment shown the taper of the central passage 17 is approximately 12°, and the orifice diameter at the passage at the tip end 18** is 0.100 inch, but of course any desired size opening can be provided, according to the size and velocity of air stream that is to be provided by the nozzle.

The threaded stub end 15 of the nozzle terminates in a flat surface 19, which bears against the back-up disc or screen 14. When the nozzle 16 is threaded into the bore 10, it thrusts the back-up screen 14 and with it the filter disc 13 and the gasket 12 snugly against the base 10c of the bore 10, thus ensuring a leak-tight seal between the filter gasket 12 and filter housing 1. The stub end 15 is long enough, so that the stub end can be inserted as far as required to obtain the necessary seal of the filter assembly 11, without the shoulder 20 of the nozzle body 21 contacting the face 22 of the filter housing 1.

In order to make it possible to thread the nozzle 16 tightly into the bore 10, the nozzle body exterior at 21 can be made square, hexagonal, or other regular polygonal shape, so that it can be tightened in the bore 10 by a wrench, or by hand.

At the periphery of the tapered passage 17, about half-way down its length, are a plurality of orifices 23, approximately 0.120 inch in diameter, opening laterally of the nozzle at an angle of 90° to the tapered passage wall. Because of the high pressure and velocity of the air passing through the tapered passage, the presence of the orifices has virtually no effect upon the velocity and pressure of the jet air stream issuing from the nozzle. In the event however that the tip opening 18 of the nozzle is blocked, such as by holding the tip against a metal surface, the orifices permit the passage of air therethrough, and serve as pressure release outlets.

It will be evident from the drawings and the preceding discussion that the assembly and disassembly of the filter nozzle in accordance with the invention so as to remove and replace the filter element 13 is quite simple. All that is necessary is that the nozzle 16 be removed by threading it out of the bore 10, whereupon the back-up screen and filter can be dropped out. The filter 13 can then be replaced, and the replacement fitted snugly at the base of the bore 10 by threading the nozzle 16 back into the bore 10.

From time to time, it is necessary to remove and replace the filter, so as to remove the microscopic particles collected on the upstream surface thereof. As a layer of material removed by the filter builds up on the filter surface, the filter surface area available for flow-through becomes obstructed, and as the open pores diminish in size and number, the pressure drop across the filter increases. If this condition were to be allowed to continue, the velocity and pressure of the air stream issuing from the nozzle would of course be progressively reduced. If this happens in use, of course this indicates the filter requires replacement. It is therefore quite important that the filter assembly be removed and cleaned from time to time.

It is also important and preferred that the filter be of hydrophobic material, i.e., water-repellent. Air in pressure air lines contains significant amounts of water. This water if the filter material were hydrophilic would tend to be absorbed by the filter material, particularly under the air pressure employed. This would swell the material, and change the pore size, reducing it, and making it more difficult to obtain the desired air flow from the nozzle. A hydrophobic material does not absorb water, and therefore does not undergo changes in dimensions during use.

Since the particles released from the air gun mechanism are particularly small, it is also important that the filter be of microporous dimensions and have a pore size of less than 2 $\mu$ and preferably less than 1 $\mu$. Filter materials of the desired pore size are known, and are described in many patents, for example, U.S, Pat. Nos. 3,158,532, patented Nov. 24, 1964, 3,238,056, patented Mar. 1, 1966, 3,246,767, patented Apr. 19, 1966, 3,407,252, patented Oct. 22, 1968, 3,353,682 , patented Nov. 21, 1967, Belgium Pat. No. 788,293, patented Mar. 1, 1973.

As indicated, the filter material is preferably hydrophobic or water-repellent. Suitable fibrous materials that are hydrophobic or water-repellent include synthetic resins and synthetic polymers such as polyamides, polethylene, polypropylene, vinyl chloride, vinylidene chloride, polyacrylonitrile, and polyesters, as well as metal screens such as stainless steel, brass and aluminum.

While the embodiments shown in the drawings have the nozzle attached to the filter housing and the filter housing attached to the air gun by way of threaded components, it is of course possible to use other types of linkages, such as bayonet joints, and lock-pin joints.

The nozzle and filter housing can also be provided with flanges, and fitted together and to the air gun by way of clamps, or nuts and bolts or screws.

It is equally satisfactory to place the filter assembly in a bore in the nozzle body, and have the filter housing thread or otherwise fit in the bore to retain the filter assembly therein, in the reverse arrangement of that shown in FIGS. 1 to 3. In such a construction, the filter assembly is attached to the filter housing across the air channel therethrough upstream of the nozzle.

Having regard to the foregoing disclosure, the following is claimed as the inventive and patentable embodiments thereof:

1. A filter nozzle for air guns comprising, in combination, a filter housing having a air channel therethrough and adapted to be mounted to an air outlet of an air gun; an air nozzle removably attached to the filter housing and having an air channel therethrough in fluid flow connection with the air channel of the filter housing, for restricting and directing the air from the air gun as an air stream; and a filter removably attached to the filter housing across the air channel upstream of the nozzle, so that air passing through the channel must pass through the filter before passing through the nozzle.

2. A filter nozzle in accordance with claim 1 in which the filter is of hydrophobic material.

3. A filter nozzle in accordance with claim 1 in which the filter is a disc fitted in a socket of the filter housing.

4. A filter nozzle in accordance with claim 1 in which the filter comprises a filter sheet and, disposed downstream thereof, a supporting back-up foraminous member retaining the filter sheet against air flow and air pressure through the filter nozzle.

5. A filter nozzle according to claim 1 in which the nozzle air channel composes at least one orifice in fluid flow connection with the air channel for relief of air pressure in the event of blockage of the air channel downstream of the orifice.

6. A filter nozzle according to claim 5 having a plurality of orifices.

7. A filter nozzle according to claim 1 in which the nozzle has a tapered air channel therethrough.

8. A filter nozzle in accordance with claim 1 in which the filter housing has a socket therein, the filter is held at the base of the socket, and the nozzle is fitted in the open end of the socket, downstream of the filter, and retains the filter in the socket.

9. A filter nozzle according to claim 7 in which the socket is threaded, and the nozzle is threaded into the threaded portion thereof.

10. A filter nozzle according to claim 1 in which the filter housing air channel has a threaded air portion receiving an adaptor for attachment to an air outlet of an air gun.

11. A air gun comprising, in combination, a housing; an air inlet and an air outlet therein; means for controlling air flow through the housing; and, attached across the air outlet, a filter nozzle in accordance with claim 1.

* * * * *